US006616200B1

(12) United States Patent
Tiesler

(10) Patent No.: US 6,616,200 B1
(45) Date of Patent: Sep. 9, 2003

(54) SLIDE LATCH ASSEMBLY

(75) Inventor: John M. Tiesler, Harrison Township, Macomb County, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/131,005

(22) Filed: Apr. 24, 2002

(51) Int. Cl.[7] ..... E05C 1/12

(52) U.S. Cl. ..... 292/164; 292/146; 292/175; 292/DIG. 61

(58) Field of Search ..... 292/164, 163, 292/175, DIG. 61, 145, 146

(56) References Cited

U.S. PATENT DOCUMENTS 2,877,919 A * 3/1959 Kobryner ..... 220/3.8
4,837,975 A * 6/1989 Simpson ..... 49/175
4,909,551 A * 3/1990 Buchanan ..... 292/175
5,121,952 A * 6/1992 Jason ..... 292/175
5,193,707 A * 3/1993 Mizumura ..... 220/326
5,628,534 A * 5/1997 Morgan ..... 292/128
5,937,585 A * 8/1999 Tidbury et al. ..... 49/504
6,161,909 A * 12/2000 Huang ..... 312/223.2
6,305,726 B1 * 10/2001 LeTrudet ..... 292/175
2002/0067044 A1 * 6/2002 Chen et al. ..... 292/117

* cited by examiner

*Primary Examiner*—Robert J. Sandy
*Assistant Examiner*—Matthew E. Rodgers
(74) *Attorney, Agent, or Firm*—Brooks & Kushman P.C.

(57) ABSTRACT

A slide latch assembly (10) includes an elongated housing (18) that slidably receives a latch pawl (36) with a leaf spring (42) having a pair of legs (44) that bias the latch pawl toward a latched position. The construction of the housing (18) and the latch pawl (36) permit the latch assembly to have a relatively thin construction.

12 Claims, 2 Drawing Sheets

SLIDE LATCH ASSEMBLY

BACKGROUND OF THE INVENTION

1. Field of the Invention

This invention relates to a slide latch assembly for selectively latching and unlatching components to each other such as latching of a closure member for movement between open and closed positions with respect to an associated access opening defined by another member.

2. Background Art

Slide latch assemblies in the prior art have conventionally included a housing and a latch pawl that is mounted on the housing for movement between latched and unlatched positions to provide a latching function such as latching a closure member in a closed position with respect to an associated access opening defined by another member. With some applications, the available space for the latch assembly is limited such that it is desirable to have a slide latch assembly that is relatively thin so as to fit into the available space.

SUMMARY OF THE INVENTION

An object of the present invention is to provide an improved slide latch assembly.

In carrying out the above object, the side latch assembly of the invention includes an elongated housing having opposite first and second ends and including a base wall and a pair of side walls that extend from the base wall in a spaced relationship from each other. A pair of retainer walls of the housing extend toward each other from the side walls in a spaced relationship from the base wall and have inner edges spaced from each other. A pair of pawl extension stops of the housing are located on the base wail respectively adjacent the pair of side walls at the first end of the housing. A pawl retraction stop of the housing is located on the base wall adjacent the other end of the housing.

The slide latch assembly also includes a latch pawl mounted between the base wall and the retainer walls of the housing for sliding movement between a latched position and an unlatched position. This latch pawl has a pair of spaced extension stops that respectively engage the pair of pawl extension stops on the base wall of the housing to limit movement of the latch pawl in one direction toward the first end of the housing past the latched position. The latch pawl also has a retraction stop that engages the pawl retraction stop on the base wall of the housing to limit movement of the latch pawl in the opposite direction toward the second end of the housing past the unlatched position.

A leaf spring of the slide latch assembly has a pair of legs that extend between the housing and the latch pawl at a location between the spaced extension stops of the latch pawl to bias the latch pawl against movement from the latched position toward the unlatched position.

The construction of the slide latch assembly as described above permits it to have a relatively thin construction that facilitates use thereof in confined spaces.

The pair of extension stops on the base wall of the housing are constructed as extension lugs each of which includes a slide surface that slidably engages the latch pawl during movement thereof between the latched and unlatched positions. Each extension lug on the housing base wall also includes a stop surface that is engaged by one of the extension stops of the latch pawl to limit movement of the latch pawl in the one direction toward the first end of the housing past the latched position. The stop surfaces of the extension lugs on the base wall of the housing are inclined with respect to the direction of movement of the latch pawl between the latched and unlatched positions.

The pair of extension stops on the latch pawl comprise extension lugs each of which includes a slide surface that slidably engages the base wall of the housing during movement of the latch pawl between the latched and unlatched positions. Each extension lug on the latch pawl also includes a stop surface that engages the stop surface of one of the extension stops of the base wall of the housing to limit movement of the latch pawl in the one direction toward the first end of the housing past the latched position. The stop surfaces of the extension lugs on the latch pawl are inclined with respect to the direction of movement of the latch pawl between the latched and unlatched positions.

The leaf spring of the slide latch assembly has a junction that connects its pair of legs to each other. A connector of the slide latch assembly connects the junction of the leaf spring to the base wall of the housing with the pair of legs of the leaf spring extending from its junction to engage and bias the latch pawl against movement from the unlatched position toward the latched position, and the leaf spring leg engagement being with the latch pawl at the extension lugs that embody the extension, stops of the latch pawl.

The pawl retraction stop on the base wall of the housing and the retraction on the latch pawl include ramp surfaces that permit insertion of the latch pawl into the housing. The pawl retraction stop on the base wall of the housing and the retraction stop on the latch pawl also includes stop surfaces that engage each other to prevent reverse withdraw movement of the latch pawl from the housing.

The latch pawl of the slide assembly has an elongated shape with opposite ends and oppositely oriented faces. The pawl retraction stop on the base wall of the elongated housing and the retraction stop on the elongated latch pawl are located at adjacent ends of the housing and the latch pawl with the retraction stop on the latch pawl being on one face of the latch pawl. The latch pawl also includes a manual actuator located on the opposite face of the latch pawl from its retraction stop and adjacent the opposite end of the latch pawl from its retraction stop.

The objects, features and advantages of the present invention are readily apparent from the following detailed description of the preferred embodiment of the invention when taken in connection with the accompanying drawings.

DETAILED DESCRIPTION OF THE PREFERRED EMBODIMENT

Figure 1:
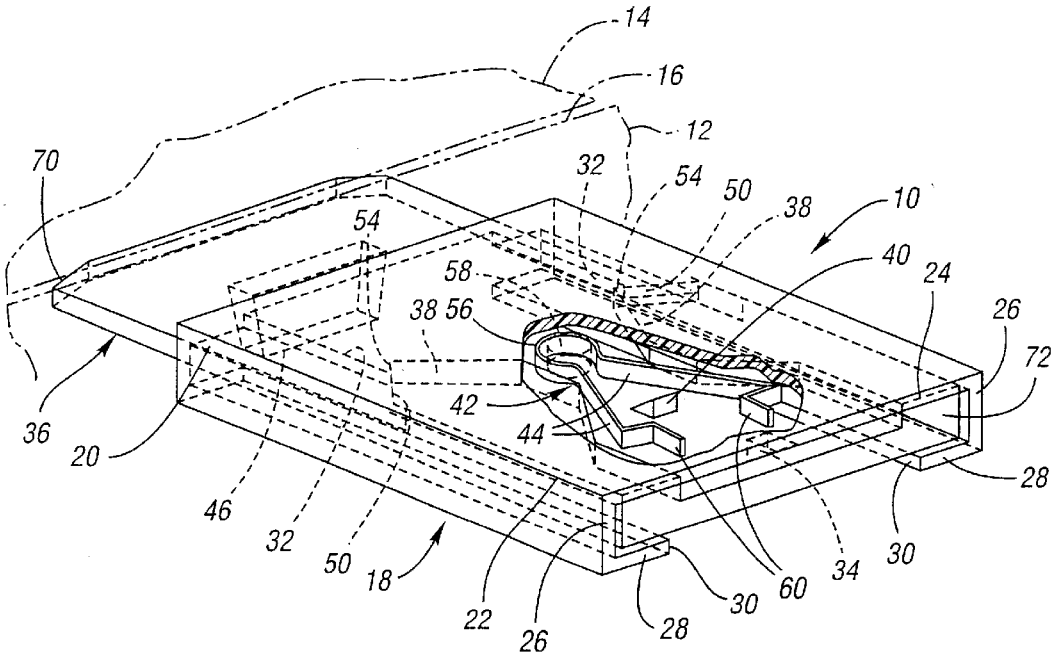
FIG. 1 is a perspective view illustrating a slide latch assembly of the invention illustrated in a latched condition.
Figure 2:
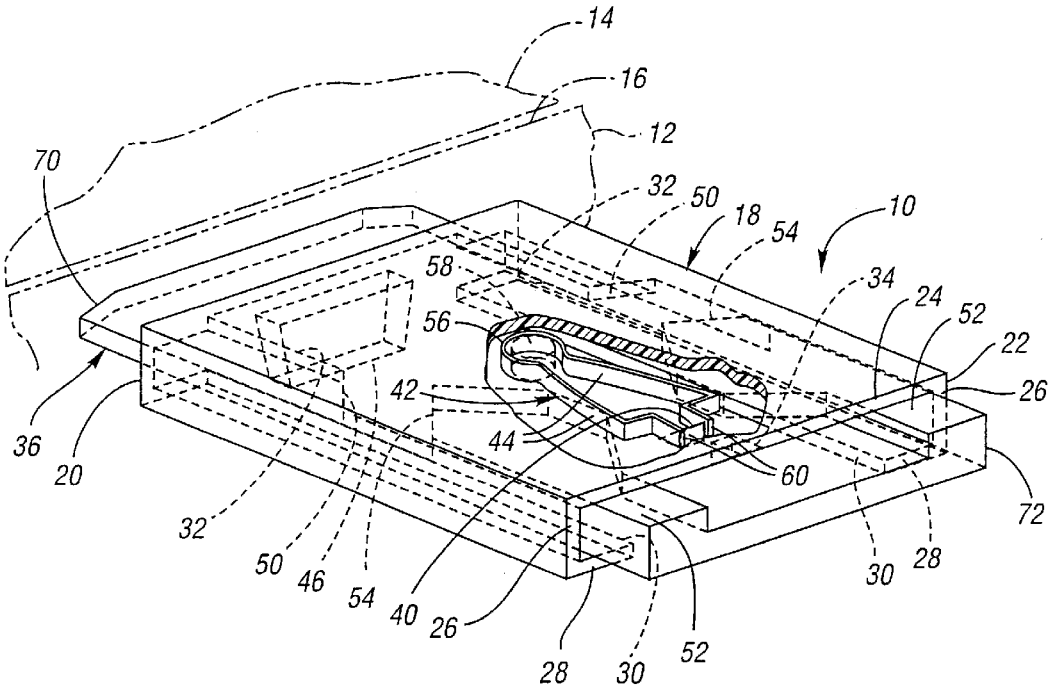
FIG. 2 is a perspective view of the slide latch assembly but shown in an unlatched condition.
Figure 3:
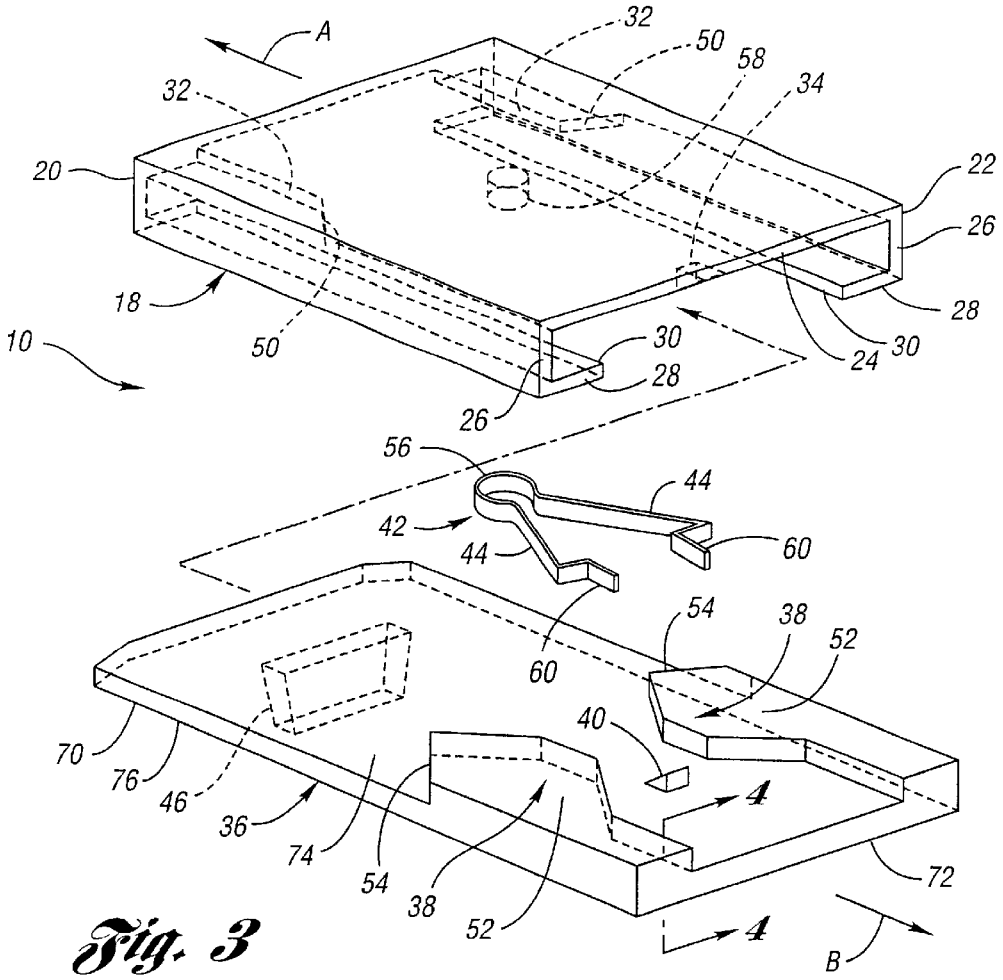
FIG. 3 is an exploded perspective view of the slide latch assembly.

With reference to FIGS. 1 through 3 of the drawings, a slide latch assembly constructed in accordance with the present invention is generally indicated by 10 and is illustrated as being operable to provide latching between a phantom line indicated housing member 12 and a phantom line indicated closure member 14 such that the closure member selectively provides opening and closing of an access opening 16 of the housing member. As illustrated, the latch assembly 10 is shown as being mounted on the housing member 12 to provide securement of an unshown keeper on the closure member 14. However, it should be appreciated that the respective positions can be reversed with the latch assembly 10 mounted on the closure member 14 to provide latching in cooperation with a keeper on the housing member 12. The latch assembly 10 is illustrated in FIG. 1 in a latched condition and is illustrated in FIG. 2 in an unlatched condition as is hereinafter more fully described.

The slide latch assembly 10 includes an elongated housing 18 having opposite first and second ends 20 and 22. The housing 18 as illustrated in FIG. 3 includes a base wall 24 and a pair of side walls 26 that extend from the base wall in a spaced relationship from each other. A pair of retainer walls 28 of the housing extend toward each other from the side walls 26 in a spaced relationship from the base well 24 and have inner edges 30 spaced from each other. A pair of pawl extension stops 32 of the housing are located on the base wall 24 respectively adjacent the pair of side walls 26 at the one housing end 20. A pawl retraction stop 34 is located on the base wall 24 adjacent the other housing end 22 at a location between the side walls 26.

As also best illustrated in FIG. 3, the latch assembly 10 includes a latch pawl 36 that is mounted between the base wall 22 and the retainer walls 28 of the housing 18 for sliding movement between the latched position illustrated in FIG. 1 and the unlatched position illustrated in FIG. 2. This latch pawl 36 as shown with continuing reference to FIG. 3 has a pair of spaced extension stops 38 that respectively engage the pair of pawl extension stops 32 on the base wall 24 of the housing 18 to limit movement of the latch pawl in the one direction shown by arrow A toward the one end of the housing past the latched position. The latch pawl also has a retraction stop 40 that engages the pawl retraction stop 34 on the base wall 24 of the housing 18 to limit movement of the latch pawl in the opposite direction shown by arrow B toward the other housing end 22 past the unlatched position illustrated in FIG. 2.

A leaf spring 42 of the latch assembly 10 has a pair of legs 44 that extend between the housing 18 and the latch pawl 36 to bias the latch pawl against movement from the latched position shown in FIG. 1 toward the unlatched position in order to maintain the latch assembly normally latched. A manual actuator 46 on the latch pawl 36 permits movement of the latch pawl against the spring bias to the unlatched position so as to permit unlatching of the slide latch assembly 10.

The construction of the latch assembly 10 as described above and as is hereinafter more fully described permits the latch assembly to have a relatively thin construction that allows it to be used in confined spaces. Specifically, as illustrated, the slide latch assembly has a thickness that is less than ¼ of its width between the side walls of the housing.

As best illustrated in FIG. 3, the pair of pawl extension stops 32 on the base wall 24 of the housing 18 comprise extension lugs each of which includes a slide surface 48 (FIG. 4) that slidably engages the latch pawl 36 during movement between the latched and unlatched positions. Each extension lug 32 on the housing base wall 24 also includes a stop surface 50 that is best shown in FIG. 3 and is engaged by one of the extension stops 38 on the pawl 36 to limit movement of the latch pawl in the one direction shown by arrow A toward the one housing end 20 past the latched position. The stop surfaces 50 of the extension lugs 32 on the base wall 24 of the housing are inclined with respect to the direction of movement of the latch pawl between the latched and unlatched positions respectively along the directions shown by arrows A and B.

As shown in FIG. 3, the pair of extension stops 38 on the latch pawl 36 comprise extension lugs each of which includes a slide surface 52 that slidably engages the base wall 24 of the housing 18 upon sliding movement between the latched and unlatched positions. Each extension lug 38 on the latch pawl 36 also includes a stop surface 54 that engages one of the extension stops 32 of the housing at its stop surface 50. The stop surfaces 54 of the latch pawl extension lugs 38 are inclined with respect to the direction of movement of the latch pawl along arrows A and B between the latched and unlatched positions like the inclined stop surfaces 50 of the pawl extension lugs 32 on the housing.

As shown in FIG. 3, the leaf spring 48 has a junction 56 that connects its pair of legs 44 to each other. A connector 58 on the housing base wall 24 is received by the leaf spring junction 56 to provide connection of the leaf spring to the housing with the pair of legs 44 of the leaf spring extending from its junction to engage and bias the latch pawl against movement from the latched position toward the unlatched position. More specifically, this engagement of the leaf spring legs 44 with the latch pawl is at its extension lugs 38 that embody the extension stops of the latch pawl. Also, the normal bias of the leaf spring legs to spread apart forces the latch pawl 46 in the latching direction illustrated by arrow A. Actuation of the manual actuator 46 forces the leaf spring legs 44 together with distal spring leg ends 60 limiting the movement of the leaf spring legs toward each other.

Figure 4:
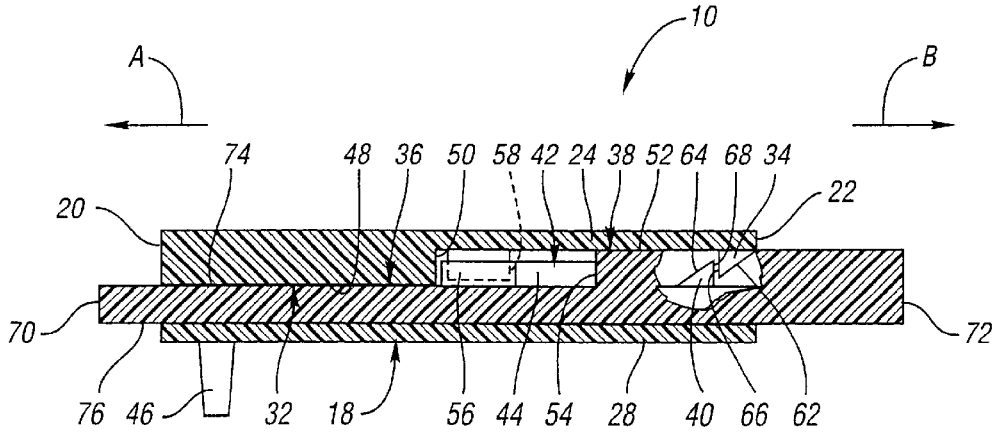
FIG. 4 is a sectional view taken along the direction of line 4—4 in FIG. 3 and partially broken away to illustrate the construction of the slide latch assembly.

As shown in FIG. 4, the pawl retraction stop 34 on the housing base wall 24 and the retraction stop 40 on the latch pawl 36 include associated ramp surfaces 62 and 64 that permit insertion of the latch pawl into the housing. The pawl retraction stop 34 on the housing base wall 24 and the retraction stop 40 on the latch pawl 36 also includes associated stop surfaces 66 and 68 that engage each other to prevent reverse withdrawal movement of the latch pawl 36 from the housing 18.

The latch pawl 36 as shown in FIG. 3 like the housing 18 has an elongated shape with opposite ends 70 and 72 and oppositely oriented faces 74 and 76. The pawl retraction stop 34 on the base wall 24 of the elongated housing 18 and the retraction stop 40 on the elongated latch pawl 36 are located at adjacent ends 22 and 72 of the housing and latch pawl with the retraction stop 40 on the latch pawl being located on one face 74 of the latch pawl. Furthermore, the manual actuator 46 of the latch pawl 36 is located on the opposite face 76 of the latch pawl from its retraction stop 40 and adjacent the opposite end 70 of the latch pawl from its retraction stop 40 that is located adjacent the latch pawl end 72.

Both the housing 18 and the latch pawl 36 of the latch slide assembly are preferably made of a suitable plastic and are made as injection moldings.

While the preferred embodiment has been described in detail, it should be appreciated that other embodiments for practicing the invention are apparent to those skilled in this art as defined by the following claims.

What is claimed is:

1. A slide latch assembly comprising:

an elongated housing having opposite first and second ends and including a base wall, a pair of side walls that extend from the base wall in a spaced relationship from each other, a pair of retainer walls that extend toward each other from the side walls in a spaced relationship from the base wall and have inner edges space from each other, a pair of pawl extension stops on the base wall respectively adjacent the pair of side walls at the first end of the housing, and a pawl retraction stop on the base wall adjacent the second end of the housing;

a latch pawl mounted between the base wall and the retainer walls of the housing for sliding movement between a latched position and an unlatched position, the latch pawl having a pair of spaced extension stops that respectively engage the pair of pawl extension stops on the base wall of the housing to limit movement of the latch pawl in one direction toward the one end of the housing past the latched position, and the latch pawl having a retraction stop that engages the pawl retraction stop on the base wall of the housing to limit movement of the latch pawl in the opposite direction toward the second end of the housing past of unlatched position; and a leaf spring having a pair of legs and a junction between the pair of legs, and a connector that connects the leaf spring leg junction to the housing base wall with the pair of legs of the leaf spring extending into engagement with the pair of spaced extension stops of the latch pawl to bias the latch pawl against movement from the latched position toward the unlatched position.

2. A slide latch assembly as in claim 1 wherein the pair of pawl extension stops on the base wall of the housing comprise extension lugs each of which includes a slide surface that slidably engages the latch pawl during movement thereof between the latched and unlatched positions, and each extension lug on the housing base wall also including a stop surface that is engaged by one of the extension stops of the latch pawl to limit movement of the latch pawl in the one direction toward the one end of the housing past the latched position.

3. A slide latch assembly as in claim 2 wherein the stop surfaces of the extension lugs on the base wall of the housing are inclined with respect to the direction of movement of the latch pawl between the latched and unlatched positions.

4. A slide latch assembly as in claim 1 wherein the pair of extension stops on the latch pawl comprise extension lugs each of which includes a slide surface that slidably engages the base wall of the housing during movement of the latch pawl between the latched and unlatched positions, and each extension lug on the latch pawl also including a stop surface that engages one of the extension stops of the base wall of the housing to limit movement of the latch pawl in the one direction toward the one end of the housing past the latched position.

5. A slide latch assembly as in claim 4 wherein the stop surfaces of the extension lugs on the latch pawl are inclined with respect to the direction of movement of the latch pawl between the latched and unlatched positions.

6. A slide latch assembly as in claim 1 wherein:

the pair of pawl extension stops on the base wall of the housing comprise extension lugs each of which includes a slide surface that slidably engages the latch pawl during movement thereof between the latched and unlatched positions, and each extension lug on the housing base wall also including a stop surface that is engaged by one of the extension stop of the latch pawl to limit movement of the latch pawl in the one direction toward the one first end of the housing past the latched position; and the pair of extension stops on the latch pawl comprise extension lugs each of which includes a slide surface that slidably engages the base wall of the housing during movement of the latch pawl between the latched and unlatched positions, and each extension lug on the latch pawl also including a stop surface that engages the stop surface of one of the extension stops of the base wall of the housing to limit movement of the latch pawl in the one direction toward the first end of the housing past the latched position.

7. A slide latch assembly as in claim 6 wherein the stop surfaces of the extension lugs on the base wall of the housing and the stop surfaces of the extension lugs on the latch pawl are each inclined with respect to the direction of movement of the latch pawl between the latched and unlatched positions.

8. A slide latch assembly as in claim 1 wherein:

the pair of pawl extension stops on the base wall of the housing comprise extension lugs each of which includes a slide surface that slidably engages the latch pawl during movement thereof between the latched and unlatched positions, and each extension lug on the housing base wall also including a stop surface that Is engaged by one of the extension stops of the latch pawl to limit movement of the latch pawl in the one direction toward the one first end of the housing past the latched position;

the pair of extension stops on the latch pawl comprise extension lugs each of which includes a slide surface that slidably engages the base wall of the housing during movement of the latch pawl between the latched and unlatched positions, and each extension lug on the latch pawl also including a stop surface that engages the stop surface of one of the extension stops of the base wall of the housing to limit movement of the latch pawl in the one direction toward the first end of the housing past the latched position; and the leaf spring having a junction that connects its pair of legs to each other, and a connector that connects the junction of the leaf spring to the base wall of the housing with the pair of legs of the leaf spring extending from its junction to respectively engage the pair of extension stops of the latch pawl to bias the latch pawl against movement from the latched position toward the latched unlatched position.

9. A slide latch assembly as in claim 1 wherein the pawl retraction stop on the base wall of the housing and the retraction stop on the latch pawl include ramp surfaces that permit insertion of the latch pawl info the housing, and the pawl retraction stop on the base wall of the housing and the retraction stop on the latch pawl also including stop surfaces that engage each other to prevent reverse withdrawal movement of the latch pawl from the housing.

10. A slide latch assembly as in claim 9 wherein the latch pawl has an elongated shape with opposite ends and oppositely oriented faces, the pawl retraction stop on the base wall of the elongated housing and the retraction stop on the elongated latch pawl being located at adjacent ends of the housing and the latch pawl with the retraction stop on the latch pawl being on one face of the latch pawl, and the latch pawl also including a manual actuator located on the opposite face of the latch pawl from its retraction stop and adjacent the opposite end of the latch pawl from its retraction stop.

11. A slide latch assembly comprising:

an elongated housing having opposite first and second ends and including a base wall, a pair of side walls that extend from the base wall in a spaced relationship from each other, a pair of retainer walls that extend toward each other from the side walls in a spaced relationship from the base wall and have inner edges spaced from each other, a pair of pawl extension stops on the base wall respectively adjacent the pair of side walls at the first end of the housing, each pawl extension stop being an extension lug that is located on the base wall and has a slide surface and stop surface, and a pawl retraction stop located on the base wall adjacent the second end of the housing;

a latch pawl mounted between the base wall and the retainer walls of the housing and slidably engaged by the slide surfaces of the extension surfaces of the sliding movement between a latched position and an unlatched position, the latch pawl having a pair of spaced extension stops that each have a slide surface that slidably engages the housing base wall and a stop surface that engages the stop surface of one of the pair of extension lugs embodying the pair of pawl extension stops on the base wall of the housing to limit movement of the latch pawl in one direction toward the first end of the housing past the latched position, the latch pawl having a retraction stop that engages the pawl retraction stop located on the base wall of the housing to limit movement of the latch pawl in the opposite direction toward the second end of the housing past of unlatched position; and a leaf spring having a pair of legs and a junction between the pair of legs, and a connector that connects the leaf spring leg junction to the housing base wall with the pair of legs of the leaf spring extending into engagement with the pair of extension lugs that embody the extension stops of to bias the latch pawl against movement from the latched position toward the unlatched position.

12. A slide latch assembly comprising:

an elongated housing having opposite first and second ends and including a base wall, a pair of side walls that extend from the base wall in a spaced relationship from each other, a pair of retainer walls that extend toward each other from the side walls in a spaced relationship from the base wall and have inner edges spaced from each other, a pair of pawl extension stops on the base wall respectively adjacent the pair of side walls at the first end of the housing, each pawl extension stop being an extension lug that is located on the base wall and has a slide surface and stop surface, and a pawl retraction stop on the base wall adjacent the second end of the housing and having a ramp surface and a stop surface;

a latch pawl mounted between the base wall and the retainer walls of the housing and slidably engaged by the slide surfaces of the extension surfaces of the sliding movement between a latched position and an unlatched position, the latch pawl having a pair of spaced extension stops that each have a slide surface that slidably engages the housing base wall and a stop surface that engages the stop surface of one of the pair of extension lugs embodying the pair of pawl extension stops on the base wall of the housing to limit movement of the latch pawl in one direction toward the first end of the housing past the latched position, the latch pawl including a retraction stop having a ramp surface that engages the ramp surface of the pawl retraction stop of the housing to permit insertion of the latch pawl into the housing, and the retraction stop of the latch pawl having a stop surface that engages the stop surface of the retraction stop on the base wall of the housing to limit movement of the latch pawl in the opposite direction toward the second end of the housing past of unlatched position; and a leaf spring having a pair of legs and a junction between the pair of legs, and a connector that connects the leaf spring leg junction to the housing base wall with the pair of legs of the leaf spring extending into engagement with the pair of extension lugs that embody the extension stops of to bias the latch pawl against movement from the latched position toward the unlatched position.

* * * * *

UNITED STATES PATENT AND TRADEMARK OFFICE

CERTIFICATE OF CORRECTION

PATENT NO. : 6,616,200 B1
DATED : September 9, 2003
INVENTOR(S) : John M. Tiesler It is certified that error appears in the above-identified patent and that said Letters Patent is hereby corrected as shown below:

Column 5,
Line 64, delete “stop” and insert therefor -- stops --.

Column 6,
Line 23, delete “Is” and insert therefor -- is --.
Line 26, delete “one”.
Line 49, delete “info” and insert therefor -- into --.

Signed and Sealed this

Second Day of March, 2004

JON W. DUDAS
*Acting Director of the United States Patent and Trademark Office*